US005472139A

United States Patent [19]

Valdman et al.

[11] Patent Number: 5,472,139

[45] Date of Patent: Dec. 5, 1995

[54] PIZZA BOX

[75] Inventors: Michael Valdman, Philadelphia, Pa.; Semyon Litvin, St.-Petersburg, Russian Federation; Igor´ Gridnev, Brooklyn, N.Y.; Vladimir M. Gerasimov, St.-Petersburg, Russian Federation; Alexey N. Zakharov, St.-Petersburg, Russian Federation; Alexander L. Ljubomirsky, St.-Petersburg, Russian Federation; Ilona Vasilevskaja, Minsk, Belarus

[73] Assignee: Invention Machine Corporation, Cambridge, Mass.

[21] Appl. No.: 125,457

[22] Filed: Sep. 22, 1993

[51] Int. Cl.[6] ..... B65D 1/34

[52] U.S. Cl. ..... 229/407; 220/356; 220/606; 220/608; 229/104; 229/120; 229/906

[58] Field of Search ..... 229/2.5 R, 902, 229/903, 906, 104, 120, 406, 407; 206/508, 509, 515, 518, 551; 220/352, 356, 606, 608, 623, 912; 426/107, 113, 114, 115, 122

[56] References Cited

U.S. PATENT DOCUMENTS

| | | | |
|---|---|---|---|
| 1,945,397 | 1/1934 | Gray | 229/906 |
| 2,036,572 | 4/1936 | Frost | 220/608 |
| 2,041,537 | 5/1936 | Frost | 229/125.26 |
| 2,350,950 | 6/1944 | Wiley | 220/356 |
| 3,335,846 | 8/1967 | Mills | 426/122 |
| 3,721,803 | 3/1973 | Distefano | 426/113 |
| 3,931,890 | 1/1976 | Davis | 206/508 |
| 3,938,726 | 2/1976 | Holden, Jr. et al. | 229/2.5 R |
| 3,958,504 | 5/1976 | Levin | 426/113 |
| 4,058,214 | 11/1977 | Mancuso | 426/113 |
| 4,121,510 | 10/1978 | Frederick | 426/113 |
| 4,127,189 | 11/1978 | Shumrack et al. | 229/2.5 R |
| 4,237,171 | 12/1980 | Laage et al. | 229/120 |
| 4,253,600 | 3/1981 | Schubert | 229/2.5 R |
| 4,260,060 | 4/1981 | Faller | 229/903 |
| 4,373,636 | 2/1983 | Hoffman | 229/2.5 R |
| 4,441,626 | 4/1984 | Hall | 229/902 |
| 4,442,969 | 4/1984 | Holden | 220/608 |
| 4,592,914 | 6/1986 | Kuchenbecker | 426/113 |
| 4,717,069 | 1/1988 | Pizzolato | 229/902 |
| 4,747,510 | 5/1988 | Mack | 206/508 |
| 4,785,160 | 11/1988 | Hart | 426/113 |
| 4,883,195 | 11/1989 | Ott et al. | 229/2.5 R |
| 5,052,559 | 10/1991 | Bressie, Jr. | 229/906 |
| 5,098,013 | 3/1992 | France et al. | 229/906 |

FOREIGN PATENT DOCUMENTS

| | | | |
|---|---|---|---|
| 660209 | 3/1965 | Belgium | 220/352 |
| 104915 | 3/1917 | United Kingdom | 220/352 |
| 1437419 | 5/1976 | United Kingdom | 229/2.5 R |

OTHER PUBLICATIONS

"The Wiley Encyclopedia of Packaging Technology", John Wiley & Sons, 1986, p. 505.

*Primary Examiner*—Gary E. Elkins
*Attorney, Agent, or Firm*—Edward Dreyfus

[57] ABSTRACT

An improved container for storing and transporting a hot pizza product that includes a top and bottom with nonzero Gauss curvatured structures over a major portion of the supporting surface so that less material need be used for fabrication without a lowering of structural integrity. The top and bottom members are adapted to nest with other like tops and bottom members to reduce the need storage space near the pizza oven where they are ready for use without preassembly. The floor of the bottom comprises upstanding projections with small top surface area to reduce the heat conduction path and to support the product above the floor to form an air insulating space between the product and the floor. The bottom member includes a sidewall that intersects the floor to form a supporting line when resting on a supporting surface, thermal conduction being limited to such line. The curved, convex shape of the floor then provides a closed air insulating space between the bottom and the resting surface. Channels are provided in the top and bottom for rigidity and to assist cutting the product and nesting completely assembled boxes for transport. Other features are disclosed.

26 Claims, 5 Drawing Sheets

PIZZA BOX

The present invention relates to pizza boxes and more particularly to pizza boxes that function to protect and maintain quality of a hot pizza product useful in carry-out and delivery services.

BACKGROUND AND PRIOR ART

The demand and market for containers or boxes useful in the pizza carry-out or delivery service has risen dramatically over the last 10 years. Today, about 1 Billion boxes are used annually in the United States for this purpose and the number of local pizza shops and the addition of pizza making capability to existing establishments continues to rise dramatically.

Conventional boxes on the market experience many technical problems related to product quality deterioration, box-material consumption, labor intensive box assembly, large storage space requirement near the oven location, single use life-time, environmental concerns, and others.

One effective and efficient box design and construction is disclosed in pending U.S. patent application Ser. No. 08/082410 entitled "Pizza Box" by M. Valdman et al, filed Jun. 24, 1993, which is a CIP of U.S. patent application Ser. No. 07/860,177 filed Mar. 30, 1992, also entitled "Pizza Box", now abandoned. Said prior applications include citations and discussions of many prior art disclosures which are incorporated herein by reference. The co-pending patent application discloses a box for protecting a hot pizza product that includes design features that avoids the aforementioned problems.

SUMMARY OF THE INVENTION

The present invention provides an improved pizza box that includes even further improvements and benefits beyond the boxes disclosed in said co-pending application alone or in combination with the prior art.

One aspect of the present invention provides a pizza box of the type described that has a bottom base section construction such that it provides significantly improved support strength compared to the prior art boxes. This permits a further reduction of material content and cost without sacrificing required strength minimums.

A further aspect of the invention includes providing in the bottom floor strengthening elements to even further reduce material content, where such elements can also function as guides for cutting the product.

A further aspect of the invention includes providing a base section floor that forms an insulating space between the undersurface of the floor and a resting surface when the box is placed thereon and said floor section including a plurality of upstanding elements such that the hot pizza product is supported on the small surface area tops of these elements. Thus, the bottom base section provides an air-insulating space below the floor section when on a resting surface and an air-insulating space between the floor upper (inner) surface and the hot pizza bottom and a third insulating layer which is the floor material itself that can comprise a minimum of material because of the shape thereof.

Another aspect of the invention includes providing at least one annular or peripheral upstanding projection near the outer portion of said floor section so that the insulating air-space between the product bottom and the floor remains substantially enclosed, preventing the flow of air into or out of said space until a pizza slice is lifted from the box.

Another aspect of the invention includes forming said upstanding projections in the shape of letters, logos, or other visual indicia.

DRAWINGS

Other and further aspects, objects and benefits of an improved pizza box according to the present invention will become apparent with following detailed description, when taken with the drawings, in which.

DETAILED DESCRIPTION OF EXEMPLARY EMBODIMENTS OF THE INVENTION

Figure 1:
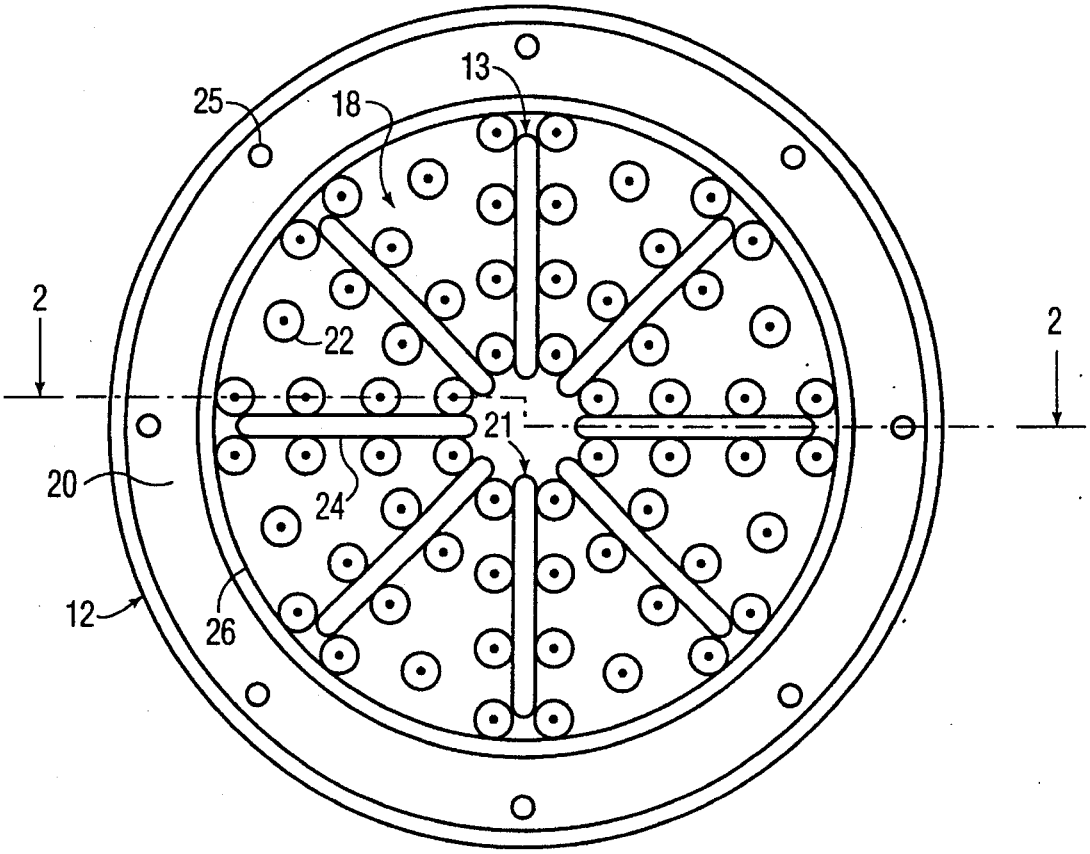
FIG. 1 is a plan view of a bottom member of a pizza box according to one example of the invention.
Figure 2:
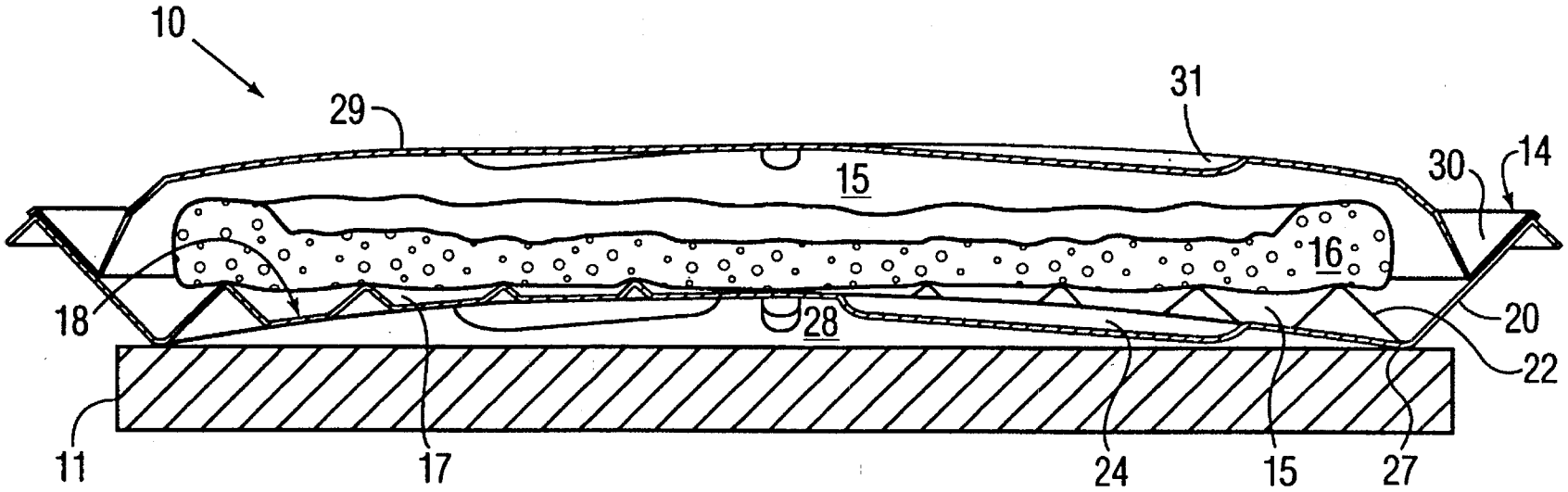
FIG. 2 is a sectional view taken along line 2—2 of FIG. 1 and FIG. 3 showing the stored product and lid or top member assembled on the bottom member to form the chamber about the product.

FIG. 1 and 2 show pizza box 10, according to the present invention, comprising a bottom member 12 and top member 14 that assemble generally as shown in FIG. 2 to form an air chamber 15 about a hot pizza product 16. Members 12 and 14 can be free-of openings or vents to achieve the advantages as described below. Bottom member 12 includes a base floor section 18 and, near the periphery thereof, an upwardly outwardly extending wall 20 that preferably forms one wall of the chamber 15. Base floor section 18 preferably comprises a single layer of insulating material, further described below, having a plurality of upstanding projections 22 spaced about the floor area and having top surface areas that are small such that the total summed surface area of the projection tops is small compared to the horizontal projection on the surface area of the base floor section 18, thus reducing or restricting thermal conduction path from the hot pizza product through the base section.

Figure 4:
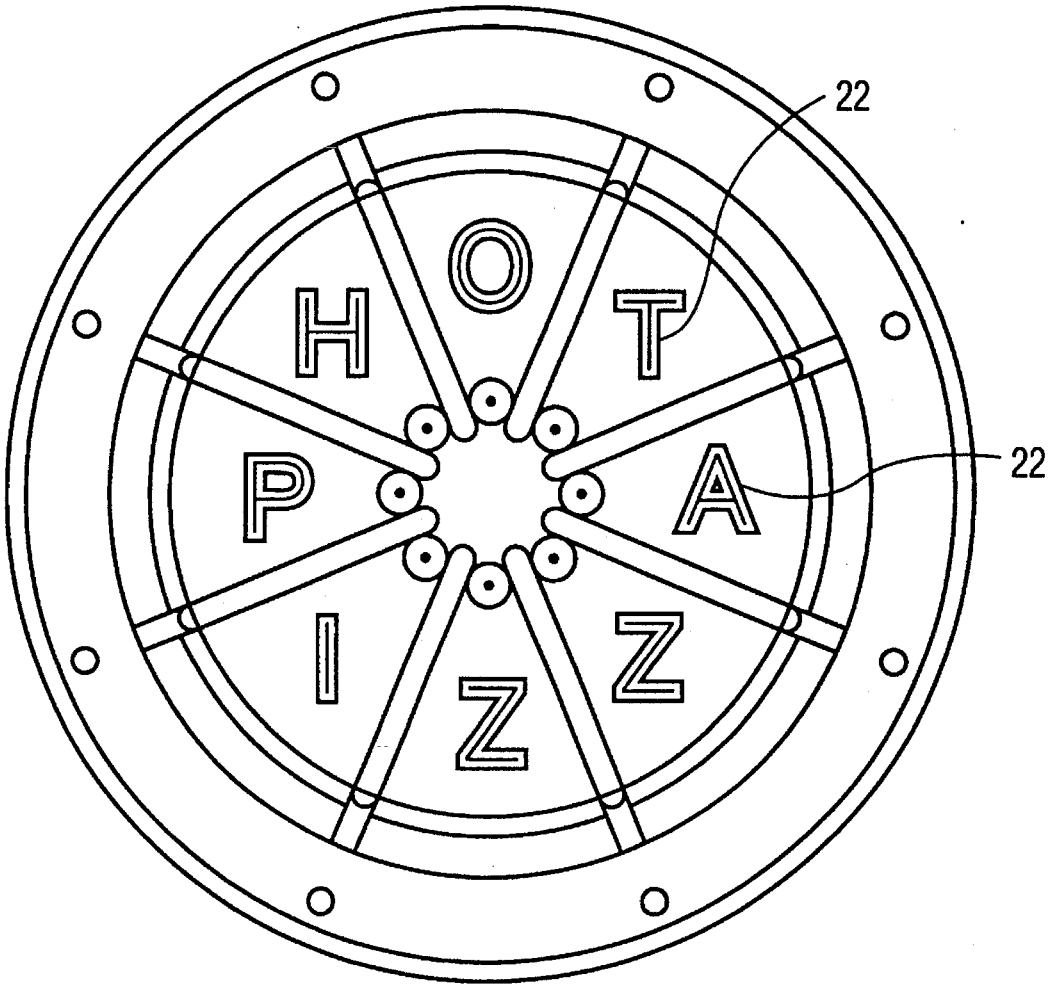
FIG. 4 is similar to FIG. 1 but shows a further embodiment of the box according to the invention.

In the example shown in FIGS. 1 and 2, the projections are substantially cone-shaped with rounded tops. However, they can be of any suitable shape such as conical, truncated conical, truncated pyramid, ramp-like, spherical, etc.. In an alternate example, some of the projections 22 form intelligent indicia such as trademarks, logos, symbols, or letters as seen in FIG. 4. The projections should, however, have a total, summed top surface area that is small compared to the horizontal surface area and the floor section 18, and they should be preferably formed so that corresponding elements nest within corresponding elements of adjacent stacked members. Also, because of the height variance of section 18, projections 22 can be of different heights above section 18 so that their tops are arranged in substantially the same horizontal plane to support the product 16 bottom in any desired orientation such as a horizontal orientation. Alternatively, the tops of the outer projections can be positioned slightly higher than the tops of the inner projections (not shown) so that the product is slightly elevated at its peripheral part to prevent product sliding or oil run off during transport, if the box is slightly tilted.

According to one aspect of the present invention, floor section 18, or major portion of the floor section, is shaped for substantial load-bearing characteristic in view of its material content. For example, floor section 18 may be bowl shaped with a cross sectional profile that is arcuate, spherical, elliptical or other suitable shape for this function, which could be mathematically described as a class of non-zero Gauss curvatures. Although, a continuous curvature is shown, it will be understood that a series of steps or flat increments can also be used within the teachings hereof to approximate these shapes. In this way, the material content of floor section 18 can be reduced without sacrificing load-bearing capability. In addition, the circular shape of the box and cooperation between the floor section 18 and the wall 20 adds to the structural integrity of the box bottom design.

Floor section 18 can also include cutting channels or guides formed below its upper or inner surfaces. Channels 24 extend generally radially from the general center of the bottom 12, but at the point 21 spaced from the center to a point 13 spaced inward from the periphery 26 of floor section 18. Thus, channels 24 function not only to aid the operator in cutting the product into equal (preferably 8) pieces, but they also strengthen the load-bearing structure of section 18 by acting as stiffeners or beams. The bottoms of channels 24 can be located above the resting surface 11 thus saving further material or, if desired, they can located to rest on surface 11 for further support. Indices, e.g. marks or embossments 25, can be applied to wall 20 to mark the radial alignment of each channel 24.

Wall 20 and floor section 18 preferably intersect at line 26 that rests on surface 11 when placed there. Section 18, therefore, encloses the air space 28 when bottom 12 is placed on surface 11. Thus, not only is the thermal conduction path or area minimized through the restricted area of line 26 but the closed air space 28 provides a further insulating layer for chamber 15.

Figure 5:
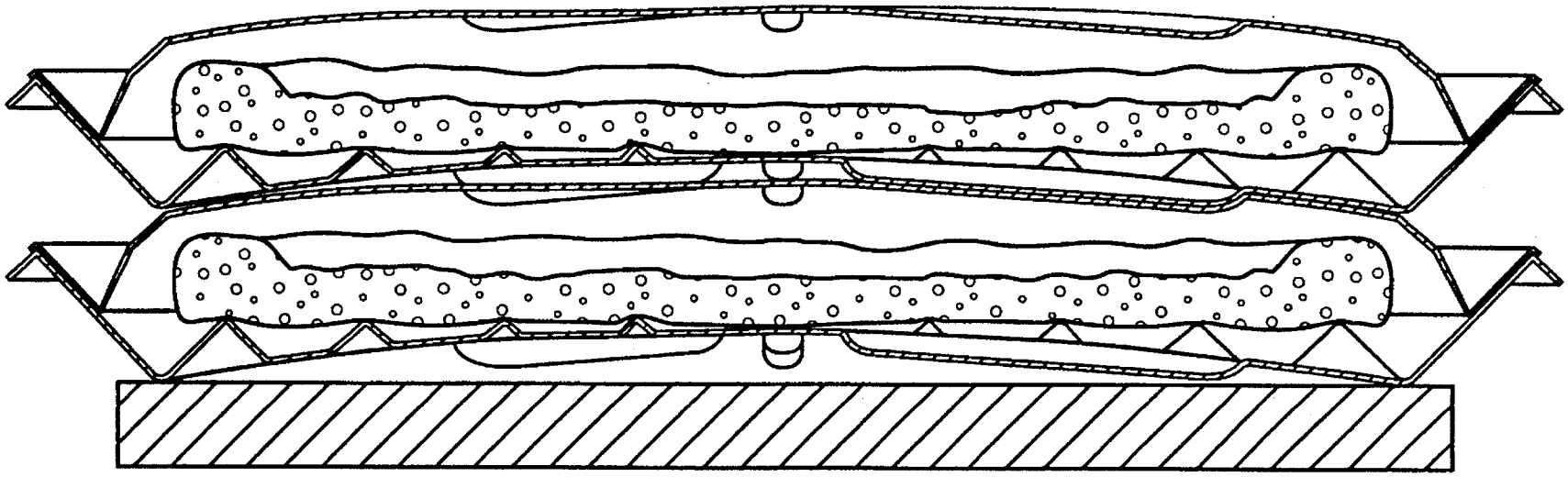
FIG. 5 shows two completed boxes of FIG. 1 storing pizza products, stacked and supported on a resting surface.

Top 14 includes a ceiling section 29 and upwardly-outwardly extending wall 30 angled to match wall 20 when placed into closing position generally as shown in FIG. 2. Section 29 can be flat across (not shown) but preferably is shaped to match the bottom floor section 18 to provide greater strength per unit material. False guides or cosmetic channels 31 can be formed in section 29 to further strengthen the top member 14 and facilitate stacking or nesting of corresponding elements of completely assembled boxes for delivery or carry-out. Two stacked boxes according to the invention are shown in FIG. 5. Note that the nested guides and tops prevent lateral movement between boxes during transport.

Bottom and top members 12 and 14 can be formed of any suitable material, however, it is preferred that they be made of single layer of molded fiber such as molded paper by well known and conventional processes. One such process produces molded paper products, such as plates, bowls and trays under the Keyes Fibre "Chinette" brand. The top and bottom members also have elements aligned so that bottom members nest with each other and top members nest with each other with no significant air space between corresponding parts yielding efficient space utilization near the oven location.

Pursuant to the above mentioned application, Ser. No. 08/082410, the inner (upper) surface of floor section 18 can be treated to be or made of liquid resistant material and/or the inner (lower) surface of ceiling section 29 can be made of or include a coating of a moisture absorbent material. These features would preserve heat in the chamber and/or prevent the bottom from absorbing drippings or vapors causing heat loss from the chamber. The above mentioned "Chinette" brand have such surface characteristics.

The shape of the ceiling section 29 can provide a run-off function for any liquid droplets condensing on the inner surface thereof that are not absorbed, which liquid droplets will tend to run or drain toward the periphery rather than fall on to the outer product crust.

Top and bottom members may include other advantages and features taught by the above mentioned prior application, Ser. No. 08/082410 such as an equilateral N-Sided (preferably 6 or 8) box shape, hinged tops and bottoms, flanged outer wall, projections flanking the cutting channels and no preassembly labor before use.

In operation, bottom members 12 are nested with other such members and top members 14 are nested with other such members in the oven area. The operator selects a member 12 and places it on a resting surface, introduces the hot product for support by the tops of projections 22. The operator can then cut the product using a roller blade by aligning it with the indicia 25 on wall 20 to follow each channel 24, yielding eight equal cut pieces. The operator then selects a top member 14 and places it into closed position as seen in FIG. 2. Walls 20 and 30 engage to essentially block air flow into or out of chamber 15. Member 12 and 14 are free of openings so that chamber 15 is essentially enclosed. Note, no labor is required to preassemble the members from blanks nor to open a container to insert the product, nor to radially orient the members 12 and 14 relative to the operator or to said members. Further, no locking tabs, inserts, or vent tabs need be provided for operator operation.

Because of the shape of floor section 18 and section 29 construction, less material need be used while still providing good structural load-bearing support by these elements and the top and bottom members as a whole. The box 10, therefore, when assembled has great structural integrity, excellent thermal insulation capability with the use of a minimum of biodegradable or recyclable material.

Figure 3:
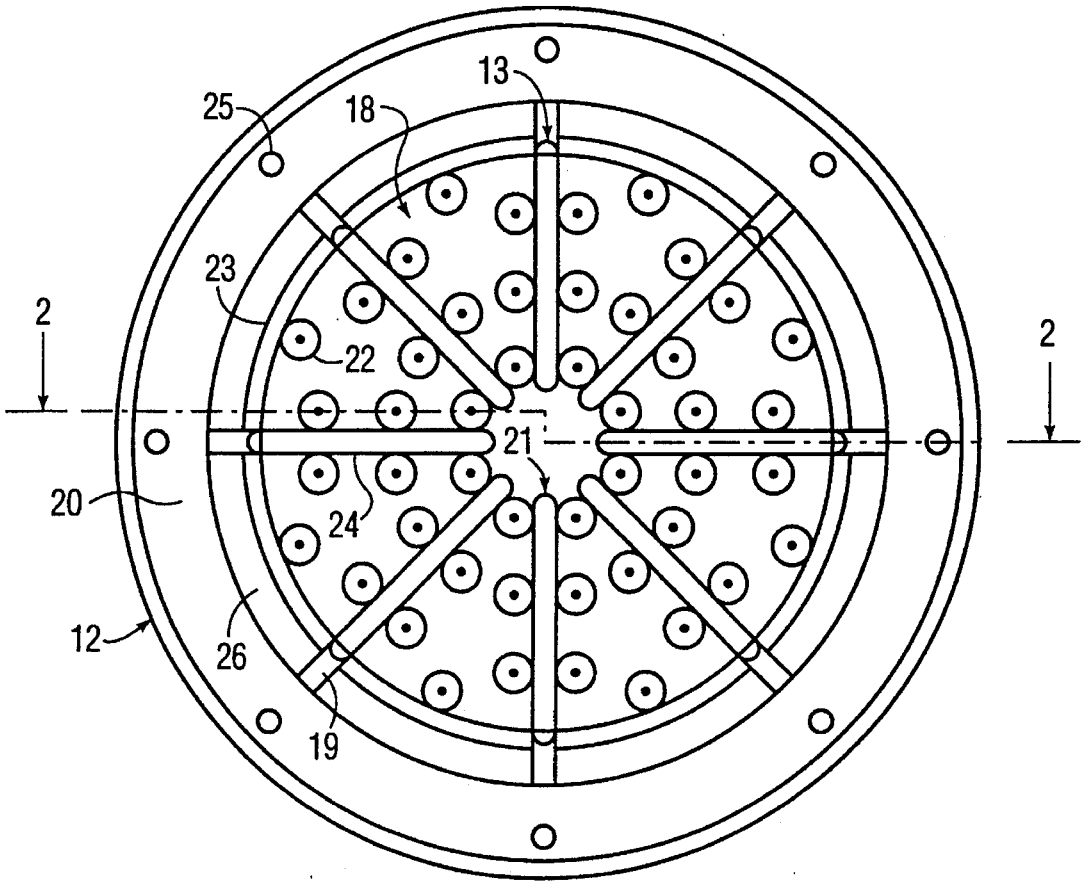
FIG. 3 is similar to FIG. 1 and shows an alternative embodiment of the box according to the invention.

With reference to FIG. 3, where like reference numerals refer to like elements of FIGS. 1 and 2, there as shown an alternate type of projection arrangement. Specifically, in addition to projections 22, a projection 23, that extends in a substantially closed path near the outer parts of section 18, is provided to also support the hot product. Thin channels 19 extend radially across projection 23 in alignment with the cutting channels 24. Thus, projection 23 cooperates with the product bottom to form a substantially closed insulating air-space 17 below a majority of the product bottom that is partially isolated from the air-space 15 in the rest of the inclosed chamber formed by members 12 and 14. This arrangement, then, somewhat enhances the thermal convection characteristics (IE, reduces thermal heat transfer due to convection within the chamber) of box 10 and tends to preserve heat in the system longer. Because the top surface of projection 23 is essentially a line with small surface area, the thermal conduction through projection 23 is not significant.

Other and further modifications and changes can be made to the examples disclosed herein without departing from the spirit and scope of the present invention. For example, the box shape could be rectangular, if desired, and the floor section could comprise a convex section of a cylinder, preferably with the axis of the cylinder aligned with the long axis of the rectangular box bottom. Other features of the present invention could be also included in combination to achieve the respective benefits.

We claim:

1. A box for storing a hot pizza product comprising, a bottom member, a top member for cooperating with said bottom member to form a chamber for protecting the hot pizza product, said bottom member comprising a floor section a major portion of which is curved to form at least one convex shaped structure for supporting weight of the hot pizza product.

2. A box according to claim 1, wherein said bottom member cooperates with a resting surface to form an enclosed insulating air-space beneath said major portion of said floor section when the bottom member is placed on the resting surface.

3. A box according to claim 1 wherein said bottom member further comprises an upwardly, outwardly extending sidewall that intersects said floor section and cooperates with a resting surface to form an enclosed, insulating air-space below the floor section when the bottom member is placed on the resting surface.

4. A box according to claim 1, wherein said bottom member further comprises an upwardly, outwardly extending peripheral sidewall, said sidewall and said floor section intersecting in a continuous line such that said continuous line contacts a resting surface when said bottom member is supported on the resting surface.

5. A box according to claim 4, wherein said floor section forms a thermal conduction path between said bottom member and the resting surface and said thermal conduction path is limited to the continuous line.

6. A box according to claim 1, wherein said floor section comprises an upper surface and a plurality of elements extending above said the upper surface, elements having tops for supporting the product such that an airspace is formed between the bottom of the product and a major part of said floor section when the product is placed thereon, said tops of said elements having a total summed surface area that is small compared with the horizontal projection of said floor section.

7. A box according to claim 6, wherein said elements have heights and said heights of respective ones of said elements are determined in relation to location of respective elements on said floor section and the position of the product desired for said location, said heights of some of said elements above said floor section being different from said heights of other, other ones of said elements above said floor section.

8. A box according to claim 6, wherein at least some of said elements are shaped to form intelligent indicia.

9. A box according to claim 6, wherein said chamber comprises an airspace above the hot pizza product and said floor section comprises a periphery and at least some of said elements are located near said periphery and are horizontally elongated to form a substantially enclosed air space between the bottom of the pizza product and upper surface of said floor section for restricting air movement between said airspace below the hot pizza product and said airspace above the hot pizza product.

10. A box according to claim 1, wherein said floor section comprises channels formed therein and extending below parts of the major portion of said floor section for strengthening said floor section.

11. A box according to claim 10, wherein said floor section has a center region and said channels extend radially from said center region of said floor section for guiding a cutting tool.

12. A box according to claim 11, wherein said floor section comprises a periphery and said guides include central-most parts spaced from said center regions and outermost parts space from said periphery.

13. A box according to claim 11, wherein said channels include bottoms spaced above a resting surface when said bottom member is supported on the resting surface.

14. A box according to claim 1, wherein said top and bottom members are free of openings for forming an enclosed chamber for the hot pizza product when said top and bottom members are assembled.

15. A box according to claim 1, wherein said top member includes a ceiling section a major portion of which is curved to form at least one convex shaped structure.

16. A box according to claim 15, wherein said major portions of said floor and ceiling sections have substantially congruous shapes.

17. A box according to claim 15, wherein said top member further includes channels extending below the lower surface of said ceiling section for increasing the weight supporting capability of said top member.

18. A box according to claim 15, wherein said top and bottom members are shaped so that said bottom member nests with other like bottom members and the top member nests with other like top members.

19. A box according to claim 1, wherein said bottom member is shaped to nest with the top member of a like box when assembled boxes are stacked for transport.

20. A box according to claim 19 wherein said top member includes a ceiling section and further includes top channels extending below the lower surface of said ceiling section and said bottom member includes bottom channels extending below the lower surface of said floor section, said top channels being nestable with said bottom channels when assembled boxes are stacked for transport.

21. A box according to claim 1, wherein said top and bottom members are separated from each other and are circular in shape, said bottom member having an upwardly and outwardly extending sidewall intersecting said floor section, said top member having a ceiling section the major portion of which is curved to form a convex structure for increasing the weight supporting capability of said top member, and an upwardly and outwardly extending sidewall intersecting the ceiling section for engaging the sidewall of said bottom member to form a closed chamber when said top member is mounted on said bottom member.

22. A box according to claim 15, wherein said ceiling section has an inner surface and said inner surface having a liquid absorbing capability.

23. A box according to claim 15, wherein the inner surface of said bottom member has a liquid resistant capability.

24. A box for storing a hot pizza product comprising, a bottom, .a top for cooperating with said bottom to form a chamber for protecting the hot pizza product, said bottom comprising a floor section a major portion of which comprises at least one convex non-zero Gauss curvature shaped structure for supporting weight of the hot pizza product.

25. A box according to claim 24, wherein said bottom cooperates with a resting surface to form an enclosed insulating air-space beneath said major portion of said floor section when said bottom is placed on the resting surface.

26. A box according to claim 24, wherein said floor section comprises an upper surface and a plurality of elements extending above said upper surface, said elements having tops for supporting the hot pizza product such that an airspace is formed between the bottom of the product and a major part of said floor section when the product is placed thereon, said tops of said elements having a total summed surface area that is small compared with the horizontal projection of said floor section.

* * * * *

UNITED STATES PATENT AND TRADEMARK OFFICE

CERTIFICATE OF CORRECTION

PATENT NO. : 5,472,139

DATED : Dec. 5, 1995

INVENTOR(S) : Valdman et al.

It is certified that error appears in the above-indentified patent and that said Letters Patent is hereby corrected as shown below:

Col. 5 In Claim 6, line 33, delete "the".
Col. 5 In Claim 7, line 46, delete "other, ".
Col. 6 In Claim 12, line 2, change "space" to "spaced".
Col. 6 In Claim 24, line 49, delete the period ".".

Signed and Sealed this

Seventh Day of May, 1996

*Attest:*

Bruce Lehman

BRUCE LEHMAN

*Attesting Officer*

*Commissioner of Patents and Trademarks*